United States Patent [19]

Thomas

[11] 4,392,316

[45] Jul. 12, 1983

[54] CEILING SUSPENDED PRODUCT DISPLAY

[76] Inventor: Paul D. Thomas, 208 S. College, McKinney, Tex. 75069

[21] Appl. No.: 117,108

[22] Filed: Jan. 31, 1980

[51] Int. Cl.[3] ..... G09F 7/22; G09F 15/00; G09F 1/08; A47G 1/16

[52] U.S. Cl. ..... 40/617; 40/539; 40/610; 40/124.1; 40/597; 248/489

[58] Field of Search ..... 40/617, 539, 610, 124.1, 40/597, 561; 248/489, 318, 317

[56] References Cited

U.S. PATENT DOCUMENTS

| | | | |
|---|---|---|---|
| 2,637,924 | 5/1953 | Hutt | 40/539 X |
| 3,030,718 | 4/1962 | Kirkman | 40/617 |
| 3,184,203 | 5/1965 | Steen | 248/318 |
| 3,284,938 | 11/1966 | Diehl et al. | 40/617 X |
| 3,327,376 | 6/1967 | Freeman et al. | 248/489 X |
| 3,936,967 | 2/1976 | Davis | 40/597 |
| 4,214,808 | 7/1980 | Hampson | 40/617 |

*Primary Examiner*—Gene Mancene
*Assistant Examiner*—Michael J. Foycik

[57] ABSTRACT

A ceiling suspended product display is shown for advertising sale product. The ceiling suspended product display a plurality of display panels suspended from a ceiling hook by suspension attachments. The display panels are interconnected by flexible hinges which permit the display panels to be folded into a compact package for storage and shipment. Upon arrival to the place of sale, the display panels may be unfolded to form a display and secured by twist ties. The ceiling hook is designed to be suspended from the rib of a false ceiling. A cord extends downwardly from the ceiling hook to a swivel. Three equal length chains are connected from the lower portion of the swivel and each of the chains are connected to eyelets in the display panels. The swivel permits the display panel to rotate under the influence of drafts in the store to attract the attention of the consumer.

35 Claims, 8 Drawing Figures

CEILING SUSPENDED PRODUCT DISPLAY

TECHNICAL FIELD

This invention relates to displays for product advertising purposes, and more particularly to a product advertising display suspended from a ceiling.

BACKGROUND ART

The display of goods to visually attract consumers forms the very heart of merchandising and selling. There is a clear relationship between the attractiveness of the display itself and the sales of the goods displayed. Counterbalancing this desire for attractiveness is the consideration of cost. The cost of the display should not be so excessive as to cause the retail price of the goods themselves to rise excessively and thereby reduce sales. The optimum result is to balance the cost and attractiveness at the point where sales are highest.

A need has thus arisen for a product advertising display which meets the two criteria of attractiveness and low cost. To be attractive, the display should have a pleasing form, distinctive colors and designs and preferably be in motion to catch the eye of the potential purchaser. To maintain a low cost, the materials forming the display should be inexpensive, the steps necessary for manufacturing the display from raw materials should be kept simple and at a minimum and the display should be designed to keep the process of mounting the sale product thereon as simple and direct as possible. In addition, since the sale product is rarely made or mounted for display where it is put on display for sale, the cost of shipping must be considered. In this regard, a collapsible display is cost effective, however the design must permit ease of assembly and positioning of the display to avoid excessive cost and delay at the place of sale.

DISCLOSURE OF THE INVENTION

In accordance with the present invention, a ceiling suspended product display for advertising sale products is provided.

In accordance with the present invention, a ceiling suspended product display includes at least one display panel. The display panels have the sale product displayed thereon. The ceiling suspended product display further includes suspension attachments for suspending the display panels from the ceiling of an enclosure. The display panels have eyelets therein for connecting the display panels and sale product to the suspension attachments. The suspension attachments include a swivel means so that the display is mobile when suspended from a ceiling.

In accordance with another aspect of the present invention, a plurality of display panels are interconnected by flexible hinges so that the display panels may be folded together to form a compact package for storage and shipping.

In accordance with another aspect of the present invention, a brad is provided on at least one of the display panels for suspending other advertisement displays from the ceiling suspended product display.

In accordance with yet another aspect of the present invention, a method of displaying sale product from a ceiling suspended product display is provided. The method includes the steps of providing at least one display panel and removably mounting sale product on the display panels. A ceiling hook is then attached to a ceiling and suspension means are hung from the ceiling hook. The display panels and sale product are then suspended from the suspension means to display the sale product.

In accordance with yet another aspect of the present invention, the method of displaying sale product from a ceiling suspended product display provided with a plurality of display panels further comprises the steps of securing hinge means interconnecting the display panels. The method further includes the steps of folding the display panels in facing relationship to a compact form for storage or shipment, with the hinge means being expanded to permit the folding, and then unfolding the display panels to display the sale product and fastening the display panels in the unfolded position by tying means.

BRIEF DESCRIPTION OF THE DRAWINGS

A more complete understanding of the invention and its advantages will be apparent from the following Detailed Description taken in conjunction with the accompanying Drawings in which.

FIGS. *3a, 3b, 3c, 3d* and *3e* are views of several embodiments of the ceiling hook of the present invention.

DETAILED DESCRIPTION

Figure 1:
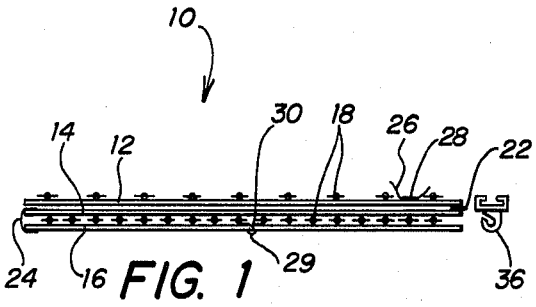
FIG. 1 is a perspective view of the ceiling suspended product display folded for storage or shipment.

FIG. 1 illustrates the preferred embodiment of the ceiling suspended product display 10 folded for storage or shipment. Ceiling suspended product display 10 includes display panels 12, 14 and 16 having sale product 18 distributed on one side of each of the display panels. In the preferred embodiment display panels 12, 14 and 16 are formed from cardboard with each having tab portions 20 as shown in FIG. 3 formed by cutouts in the cardboard for securing sale product 18 thereon. It is clear, however, that the display panels may be formed from metal, plastic, laminate, wire or any other suitable material. It is also clear that any other type of means to attach the sale product 18 to the display panels is also contemplated, including the use of separate hooks, clamps, staples or any other suitable method.

A flexible hinge 22 hingeably connects adjacent edges of display panels 12 and 14 together, and expanded flexible hinge 24 hingeably connects adjacent edges of display panels 14 and 16. In the preferred embodiment illustrated in FIG. 1, the flexible hinges 22 and 24 are formed from tape having adhesive on one side and secured to the side opposite the sale product bearing side of the display panels. It is clear that the hinge may be placed on the opposite side of the display panels. Expanded flexible hinge 24 may also be formed of an expanding material that expands to the extent shown in FIG. 1. Any other suitable hinge may be employed in the invention, including a metal piano hinge, an elastic hinge, forming or scoring the display panels and hinges by crimping portions of an integral material or hingeably connecting the display panels with a plurality of ties. Flexible hinge 22 permits display panels 12 and 14 to be folded with their sides opposite the product bearing side facing one another. It is clear from FIG. 1 that expanded flexible hinge 24 must be expanded to permit display panels 14 and 16 with their product bearing sides facing one another. Hinge 24 may be expanded by making hinge 24 wide enough to accommodate sale product 18 or forming hinge 24 or expandable material. If the sale product 18 on each display panel 14 and 16 are abutting, the expanded flexible hinge 24 must be expanded to allow a separation distance between the display panels of twice the thickness of a single sale product 18. If the sale product 18 on the two display panels 14 and 16 is distributed to permit an interfacing of the product, the expanded flexible hinge 24 need only be expanded to permit a separation between display panels 14 and 16 of a single thickness of sale product 18.

The folded ceiling suspended product display 10 also includes twist ties 26 which are taped by tape 28 to one of the display panels as shown. The twist ties 26 are used to secure display 10 in the unfolded state for display as described hereinafter. A hole 29 is provided near the lower edge of display panel 16 as shown. A brad 30 is placed within hole 29 with its tabs spread to maintain brad 30 within hole 29. This brad may be used for suspending additional advertising displays from ceiling suspended product display 10 if desired after the display 10 has been suspended from a ceiling. An S hook, or other similar device could be substituted for brad 30 if desired. Display 10 additionally includes suspension attachments 32 positioned between the display panels for storage or shipment with the exception of ceiling hook 36. Suspension attachments 32 will be described in greater detail in reference to FIG. 2.

Figure 2:
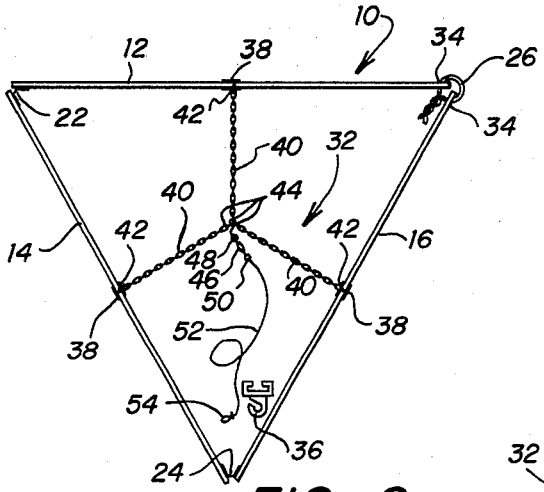
FIG. 2 is a top view of the ceiling suspended product display with the display panels unfolded and secured in the display position.
Figure 3A:
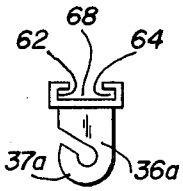
Figure 3B:
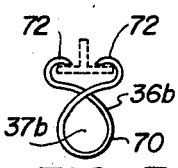
Figure 3C:
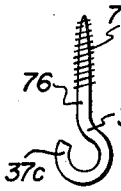
Figure 3D:
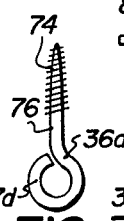
Figure 3E:
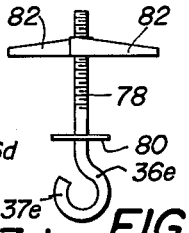

FIG. 2 illustrates the ceiling suspended product display 10 unfolded just prior to suspending from a ceiling. After receipt of the folded display 10 by the store or shop in which the display 10 will be employed, the display 10 is unfolded by pivoting display panels 12, 14 and 16 about their hinges 22 and 24 to form a prism-like shape with the edges of display panels 12 and 16 opposite the hinged edges abutting each other. Two holes 34 are formed adjacent the abutting edges in both display panels 12 and 16. Twist ties 26 are removed from display panel 12 by tearing tape 28 and are inserted through holes 34. Their ends are twisted together as shown in FIG. 2 to secure the edges of display panels 12 and 16 together. In this manner, the display panels 12, 14 and 16 form a rigid prism-like form. Twist ties 26 cooperating with holes 34 are a convenient way to secure the edges of the display panels 12 and 16 together, however, any other suitable method, such as tape or staples would be adequate.

It is clear that the present invention need not be limited to three display panels, but may encompass a display having 1, 2, 4 or more display panels. If only one display panel is provided, sale product 18 may be put on both sides of the display panel and no hinge would be necessary. If two display panels are provided, a flexible hinge may be used to interconnect the two panels in facing relationship for storage, shipment and display. In addition, the ceiling suspended product display 10 may include a single flexible panel shaped into a cylinder or similar shape.

Greater details of the suspension attachments 32 are shown in FIG. 2. A ceiling hook 36 is provided and designed to be secured to a ceiling within an enclosure and has a hook 37 for suspending the display panels. Each of the display panels 12, 14 and 16 have eyelets 38 formed near their top edge. Three equal length chains 40 are secured to eyelets 38 at one end thereof by lower hooks 42. At the opposite end of the three equal length chains 40, upper hooks 44 are attached to a swivel 46 at bottom eye 48. The top eye 50 of swivel 46 forms a point of attachment for one end of cord 52. At the opposite end of cord 52, a loop 54 is formed that is inserted into the hook 37 of ceiling hook 36.

It is clear that any material, such as string, cable, ribbon, or wire may be substituted for chains 40 and cord 52. It is also clear that lower hooks 42, upper hooks 44, bottom eye 48, top eye 50 and loop 54 may be of any suitable configuration meeting the requirement to connect the various components of the display 10. A pulley may also be attached to ceiling hook 36 if desired.

FIG. 3 illustrates five embodiments of hook 36 which may be used in the present invention to suspend the ceiling suspended product display 10 from a ceiling. The various embodiments of ceiling hook 36 permit the display 10 to be suspended from various commonly encountered ceiling structures.

Ceiling hooks 36*a* and 36*b* are designed for use with a false ceiling of the type well known in the prior art.

Figure 4:
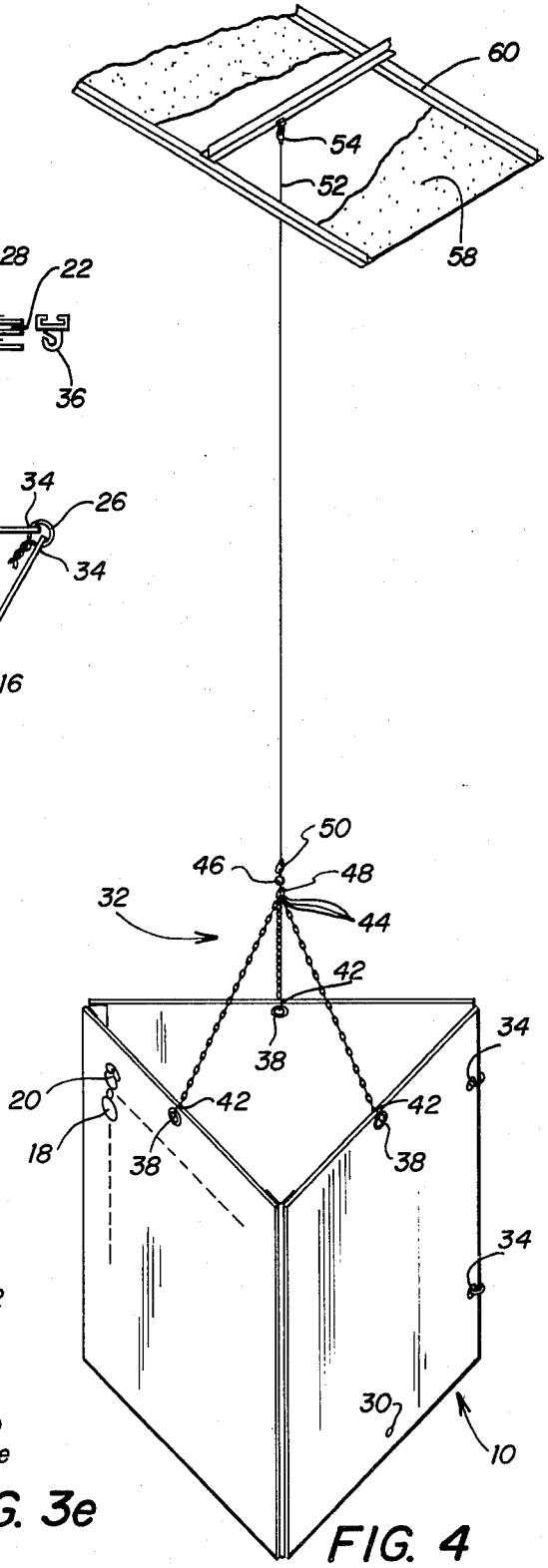
FIG. 4 is a perspective view of the ceiling suspended product display in place suspended from a ceiling.

As shown in FIG. 4, the false ceiling includes acoustic panels 58 which are suspended on a network of ribs 60. In a cross section, the ribs 60 form a t-shape having a single vertical leg suspended from above, and two horizontal portions extending from the lower end of the vertical leg in opposite directions.

The ceiling hook 36*a* is disclosed and claimed in U.S. Pat. No. 4,112,550 issued to Stuart Dewitt and James S. Dewitt. The ceiling hook 36*a* is designed with two flexible lip portions 62 and 64 and a bearing surface 66. The ceiling hook 36*a* is formed from flexible materials so that the lips 62 and 64 may be bent over the outer edges of the horizontal portions of rib 60. In that position, bearing surface 66 abuts the bottom surface of rib 60. Lips 62 and 64 maintain the ceiling hook 36*a* on rib 60.

Ceiling hook 36*b* is formed from a continuous length of wire. The wire is formed into a loop portion 70 and the ends of the wire are bent into hooks 72. As can be seen in FIG. 3, loop 70 creates a springing action that maintains hooks 72 over the horizontal portions of rib 60 for suspending the display 10.

Ceiling hooks 36*c*, 36*d* and 36*e* may be employed in a ceiling of the type having a number of studs supported by vertical members at their ends and supporting a flat sheetrock ceiling panel. Ceiling hooks 36*c* and 36*d* have threaded portions 74 and shank portions 76 and are designed to be screwed through the sheetrock and into the stud, thereby forming a secure attachment to suspend display 10 therefrom. Ceiling hooks 36*c* and 36*d* differ only in their hooks 37*c* and 37*d*. Hook 37*c* is open, whereas hook 37*d* forms an eye hook. The ceiling hook 36*e* is of the type commonly known as a molley hook. Ceiling hook 36*e* has a threaded portion 78 and bearing portion 80. A nut 82 having flexible wings thereon is threadedly engaged to threaded portion 78. A hole is formed in the sheetrock of the ceiling of sufficient diameter to permit the portion 82 to pass therethrough with the wings collapsed against the threaded portion 78. Once portion 82 is through the hole, the wings expand to secure the hook within the ceiling. It is clear that the embodiments of ceiling hook 36 described and illustrated herein may be substituted for by any other suitable means.

FIG. 3 illustrates the ceiling suspended product display 10 suspended from a ceiling to display the sale product 18 to consumers. In the preferred embodiment, a false ceiling of the type well known in the prior art is employed. The embodiment 36*a* of ceiling hook 36, described hereinabove and illustrated in FIG. 3, is connected to a rib 60 as described hereinabove.

Loop 54 is then placed in hook 37 of ceiling hook 36, and the ceiling suspended product display 10 is thereby suspended from the ceiling. It is clear that hook 37 may be formed into an eye and perform the same function.

The panels 12, 14 and 16 of the ceiling suspended product display 10 are preferably provided with distinctive colors and designs thereon for attracting the purchaser. The manufacturers trademark and identifying information may also be placed on the design panels, permitting the purchaser to rapidly identify the product.

The ceiling suspended product display 10 described hereinabove has several significant advantages. The ceiling hook 36 is designed to permit the display 10 to be suspended from the typical and very common ceiling structures found in many stores and places of business. The various embodiments of hook 36 are also designed to suspend display 10 from the ceiling with a minimum amount of effort and require only minor or no modifications of the ceiling. The display 10 is thereby suspended in a manner permitting the floorspace and counterspace of the store to be used for other functions. The display 10 is also positioned so that it will not interfere with the movement of people or goods through the store. The swivel 46 permits the display 10 to rotate about the cord 52 by means of air currents within the store and thereby functions to attract the attention of consumers. The display 10 unfolded forms a pleasing shape to the eye of the consumer which further attracts attention. However, as discussed hereinabove, the display 10 is folded for storage and shipment to minimize the cost and difficulty of transporting the display 10 and sale product 18 from the point of manufacture to the point of sale.

While only one embodiment of the present invention has been described in detail herein and shown in the accompanying drawings, it will be evident that various further modifications are possible without departing from the scope of the invention.

I claim:

1. A ceiling suspended product display comprising:

a plurality of display panels having sale product mounted thereon, each display panel further having at least one eyelet formed therein;

hinge means pivotally interconnecting said display panels at adjacent edges of said display panels, said hinge means permitting said display to be folded in a compact form for storage or shipment with said display panels in facing relationship;

a ceiling hook connected to a ceiling;

suspension means suspending said display panels from said ceiling hook, said suspension means being connected to said display panels at said eyelets, said suspension means having swivel means permitting said display panels to rotate relative to said ceiling hook; and each of said display panels being pivotal about said hinge means to unfold said display with the edges of two of said display panels opposite the hinged edges abutting to form a multi-sided structure, the sale product being mounted on the side of each of said display panels facing outward when said display is unfolded, said display permitting said display panels to rotate relative to said ceiling hooks to attract attention, the multi-sided structure maintaining the product in view continuously during rotation.

2. The ceiling suspended product display of claim 1 wherein said suspension means further comprises:

at least one chain, each of said chains being of equal length and connected at one end to an eyelet formed in each of said display panels and at the opposite end to the bottom eye of said swivel means; and a cord, one end of said cord being secured to the top eye of said swivel means and the opposite end of said cord having a loop thereon for connecting said cord to said ceiling hook.

3. The ceiling suspended product display of claim 1 wherein said display comprises three display panels, said display panels forming a prism-like structure when said display is unfolded with the edges of two of said display panels opposite the hinged edges abutting and the sale product being displayed on the outer surface of the prism-like structure, said hinge means further permitting said display to be maintained unfolded for displaying said sale product;

said display further having tying means permitting said display to be maintained unfolded for displaying said sale product.

4. The ceiling suspended product display of claim 1 wherein said ceiling hook is connected to a false ceiling having ceiling ribs and comprises:

a hook for suspending said suspension means;

a first flexible lip;

a second flexible lip; and said first and second flexible lips engaging opposite edges of a ceiling rib in the false ceiling for connecting said ceiling hook to said false ceiling.

5. The ceiling suspended product display of claim 1 wherein the ceiling hook is connected to a false ceiling having ceiling ribs and comprises a length of wire formed into a loop portion and having ends formed into hook portions engaging opposite edges of a ceiling rib in a false ceiling for connecting said ceiling hook to said false ceiling.

6. The ceiling suspended product display of claim 1 wherein said ceiling hook comprises a screw hook.

7. The ceiling suspended product display of claim 1 wherein said ceiling hook comprises a molley hook.

8. The ceiling suspended product display of claim 1 further comprising a brad secured to at least one of said display panels for suspending an additional display from said ceiling suspended product display.

9. The ceiling suspended product display of claim 1 wherein said display panels are formed from cardboard.

10. A ceiling suspended product display comprising:

a plurality of display panels having sale product mounted thereon, each display panel further having at least one eyelet formed therein;

hinge means pivotally interconnecting said display panels at adjacent edges of said display panels, said hinge means permitting said display to be folded in a compact form for storage or shipment with said display panels in facing relationship, said hinge means interconnecting adjacent panels having sale product therebetween such that when said display is folded said hinge means is expanded to permit said adjacent display panels to be folded in facing relationship, each of said display panels being pivotal about said hinge means to unfold said display with the edges of two of said display panels opposite the hinged edges abutting to form a multi-sided structure, the sale product being mounted on the side of each of said display panels facing outward when said display is unfolded;

tying means permitting said display to be maintained unfolded for displaying said sale product;

a ceiling hook connected to a ceiling; and suspension means suspending said display panels from said ceiling hook, said suspension means being connected to said display panel at said eyelets, said suspension means having swivel means permitting said display panels to rotate relative to said ceiling hook to attract attention, the multi-sided structure maintaining the product in view continuously during rotation.

11. The ceiling suspended product display of claim 10 wherein said suspension means further comprises:

a plurality of equal length chains, each of said chains being connected at one end to an eyelet formed in each of said display panels and at the opposite end to the bottom eye of said swivel means; and a cord, one end of said cord being secured to the top eye of said swivel means and the opposite end of said cord having a loop thereon for connecting said cord to said ceiling hook.

12. The ceiling suspended display of claim 10 wherein said display comprises three display panels, said display panels forming a prism-like structure when said display is unfolded with the edges of two of said display panels opposite the hinged edges abutting and the sale product being displayed on the outer surface of the prism-like structure, said tying means comprising twist ties attached to one of said display panels during storage or shipment, said twist ties being removed from said display panel when said display is unfolded for displaying said sale product, said twist ties passing through holes formed in two of said display panels near said abutting edges, the ends of said twist ties being twisted together to maintain said display unfolded for displaying said sale product.

13. The ceiling suspended display of claim 10 wherein said ceiling hook is connected to a false ceiling having ceiling ribs and comprises:

a hook for suspending said suspension means;

a first flexible lip;

a second flexible lip; and said first and second flexible lips engaging opposite edges of a ceiling rib in the false ceiling for connecting said ceiling hook to said false ceiling.

14. The ceiling suspended product display of claim 10 wherein the ceiling hook is connected to a false ceiling having ceiling ribs and comprises a length of wire formed into a loop portion and having ends formed into hook portions engaging opposite edges of a ceiling rib in a false ceiling for connecting said ceiling hook to said false ceiling.

15. The ceiling suspended product display of claim 10 wherein said ceiling hook comprises a screw hook.

16. The ceiling suspended product display of claim 10 wherein said ceiling hook comprises a molley hook.

17. The ceiling suspended product display of claim 10 further comprising a brad secured to at least one of said display panels for suspending an additional display from said ceiling suspended display.

18. The ceiling suspended product display of claim 10 wherein said display panels are formed from cardboard.

19. A ceiling suspended product display suspended from a ceiling comprising:

a first display panel;

a second display panel;

a third display panel;

said first, second and third display panels each having one side with sale product mounted thereon, each of said first, second and third display panels further having at least one eyelet formed therein;

a first hinge means pivotally interconnecting said first display panel and second display panel so that said display panels may be pivoted to a folded position with the sides of each of said first and second display panels opposite the side having sale product mounted thereon abutting;

a second hinge means pivotally interconnecting said second display panel and said third display panel so that said display panels may be pivoted to a folded position, said second hinge means being expanded so that said second display panel and said third display panel may be folded in facing relationship with said sale product attached to said second display panel and said third display panel therebetween;

said first, second and third display panels being pivotal about said first and second hinge means to an unfolded position so that the edges of said first and third display panels opposite the edges of said first and third display panels having said first and second hinges thereon are abutting to form a prism-like structure, said sale product being on the outside surface of said prism-like structure;

twist ties passing through holes in said first and third display panels near said abutting edges, the ends of said twist ties being twisted together to maintain said adjacent edges in proximate contact;

a first, second and third chain, each of said chains being of equal length and each attached at one end to an eyelet in said first, second and third display panels, respectively;

swivel means, the ends of said first, second and third chains opposite the ends attached to said first, second and third display panels being attached to a bottom eye of said swivel means;

a cord, one end of said cord being attached to the top eye of said swivel means;

a ceiling hook, said ceiling hook suspending said first, second and third display panels from the ceiling for displaying said sale product; and said swivel means permitting rotation of said first, second and third display panels relative to said ceiling hook.

20. The ceiling suspended product display of claim 19 wherein said ceiling hook is connected to a false ceiling having ceiling ribs and comprises:

a hook for suspending said suspension means;

a first flexible lip;

a second flexible lip; and said first and second flexible lips engaging opposite edges of a ceiling rib in the false ceiling for connecting said ceiling hook to said false ceiling.

21. The ceiling suspended product display of claim 19 wherein the ceiling hook is connected to a false ceiling having ceiling ribs and comprises a length of wire formed into a loop portion and having ends formed into hook portions engaging opposite edges of a ceiling rib in a false ceiling for connecting said ceiling hook to said false ceiling.

22. The ceiling suspended product display of claim 19 wherein said ceiling hook comprises a screw hook.

23. The ceiling suspended product display of claim 19 wherein said ceiling hook comprises a molley hook.

24. A method of displaying sale product from a ceiling suspended product display comprising the steps of:

providing a plurality of display panels, each having at least one eyelet therein;

securing hinge means pivotally interconnecting said display panels;

folding said display panels in facing relationship to a compact form for storage or shipment;

pivoting each of said display panels about said hinge means to unfold said display with the edges of two of said display panels opposite the hinged edges abutting to form a multi-sided structure, the sale product being mounted on the side of each of said display panels facing outward when said display is unfolded;

attaching a ceiling hook to the ceiling of an enclosure within which said display product is to be displayed;

hanging suspension means from said ceiling hook, said suspension means having swivel means thereon; and suspending said display panels at said eyelets from said suspension means to display said sale product, said swivel means permitting said display panels to rotate relative to said ceiling hook to attract attention, the multi-sided structure maintaining the product in view continuously during rotation.

25. In the method of claim 24, the step of providing a plurality of display panels comprising the step of providing three display panels, said method further comprising the steps of:

unfolding said display panels so that said sale product is displayed, said step of unfolding said display panels forming a prism-like structure; and fastening said display panels in the unfolded position by tying means.

26. In the method of claim 24 the step of attaching said ceiling hook to the ceiling wherein said ceiling is a false ceiling having ceiling ribs comprising the steps of:

placing a first flexible lip of said ceiling hook over one edge of a ceiling rib; and deforming said ceiling hook so that a second flexible lip of said ceiling hook engages the opposite edge of said ceiling rib to attach said ceiling hook to said ceiling.

27. In the method of claim 24, the step of attaching said ceiling hook to the ceiling wherein the ceiling hook is attached to a false ceiling having ceiling ribs and comprises a length of wire formed into a loop portion and having ends formed into hook portions engaging opposite edges of a ceiling rib in a false ceiling for attaching said ceiling hook to said false ceiling.

28. In the method of claim 24, the step of attaching said ceiling hook to the ceiling wherein said ceiling hook comprises a screw hook.

29. In the method of claim 24, the step of attaching said ceiling hook to the ceiling wherein said ceiling hook comprises a molley hook.

30. The method of claim 24 further comprising a step of inserting a brad in at least one of said display panels for hanging an additional display therefrom.

31. A method of displaying sale product from a ceiling suspended product display comprising the steps of:

providing three display panels, each having at least one eyelet therein;

removably mounting sale product on one side of each of said display panels;

securing two hinge means pivotally interconnecting said display panels;

folding said display panels in facing relationship to a compact form for storage or shipment, one of said hinge means being expanded to permit two of said display panels to be folded in facing relationship with said sale product therebetween;

unfolding said display panels so that said display panels form a prism-like structure, the outer surface of said prism-like structure having said sale product displayed thereon;

fastening said display panels into said prism-like structure by tying means;

attaching a ceiling hook to the ceiling;

hanging suspension means from said ceiling hook, said suspension means comprising a cord suspended from said ceiling hook, a swivel means suspended from said cord and three equal length chains suspended from said swivel means; and suspending each of said display panels at said eyelets from one of said equal length chains to display said sale product, said swivel means permitting said display panels to rotate in relation to said ceiling hook.

32. In the method of claim 31, the step of attaching said ceiling hook to the ceiling wherein said ceiling is a false ceiling having ceiling ribs comprising the steps of:

placing a first flexible lip of said ceiling hook over one edge of a ceiling rib; and deforming said ceiling hook so that a second flexible lip of said ceiling hook engages the opposite edge of said ceiling rib to attach said ceiling hook to said ceiling.

33. In the method of claim 31, the step of attaching said ceiling hook to the ceiling wherein the ceiling hook is attached to a false ceiling having ceiling ribs and comprises a length of wire formed into a loop portion and having ends formed into hook portions engaging opposite edges of a ceiling rib in a false ceiling for attaching said ceiling hook to said false ceiling.

34. In the method of claim 31, the step of attaching said ceiling hook to the ceiling wherein said ceiling hook comprises a screw hook.

35. In the method of claim 31, the step of attaching said ceiling hook to the ceiling wherein said ceiling hook comprises a molley hook.

* * * * *